US012595662B2

(12) United States Patent
Pegher

(10) Patent No.: US 12,595,662 B2
(45) Date of Patent: Apr. 7, 2026

(54) WALL PANEL CLIP

(71) Applicant: Nucor Insulated Panel Group, LLC, Wilmington, DE (US)

(72) Inventor: Gregory D. Pegher, Pittsburgh, PA (US)

(73) Assignee: Nucor Insulated Panel Group LLC., a Nucor Company, Charlotte, NC (US)

( * ) Notice: Subject to any disclaimer, the term of this patent is extended or adjusted under 35 U.S.C. 154(b) by 121 days.

(21) Appl. No.: 17/959,577

(22) Filed: Oct. 4, 2022

(65) Prior Publication Data

US 2023/0113988 A1 Apr. 13, 2023

Related U.S. Application Data

(60) Provisional application No. 63/253,951, filed on Oct. 8, 2021.

(51) Int. Cl.
*E04F 13/08* (2006.01)

(52) U.S. Cl.
CPC ..... *E04F 13/0823* (2013.01); *E04F 13/0816* (2013.01)

(58) Field of Classification Search
CPC . E04F 13/076; E04F 13/0801; E04F 13/0821; E04F 13/0823; E04F 13/0825; E04F 13/0826; E04F 13/0828; E04F 13/0837; E04F 13/0844; E04F 13/0846; E04F 13/085; E04F 13/0889; E04F 13/0891; E04F 13/0894; E04F 13/0878; E04F 13/0841; E04C 2/292
See application file for complete search history.

(56) References Cited

U.S. PATENT DOCUMENTS 3,667,180 A * 6/1972 Tischuk ..... E04F 13/0803 52/592.4
3,777,430 A * 12/1973 Tischuk ..... E04C 2/292 52/309.9
3,797,190 A * 3/1974 Widdowson ..... E04C 2/292 52/592.4
3,828,493 A * 8/1974 Vezmar ..... F16B 5/0258 411/391
4,037,377 A * 7/1977 Howell ..... E04C 2/296 52/592.1
4,123,885 A * 11/1978 Scott ..... E04F 13/12 52/489.1

(Continued)

*Primary Examiner* — Kyle J. Walraed-Sullivan
(74) *Attorney, Agent, or Firm* — Moore & Van Allen PLLC; Jeffrey R. Gray

(57) ABSTRACT

A wall panel system having a wall panel clip disposed between a first wall extended portion and a second wall panel recessed portion. The wall panel clip including a first web member and a second web member extending at an angle from the first web member. The first web member and the second web member have a first end portion, a second end portion and a middle portion. The wall panel clip further includes a through hole extending through each of the middle portion of the first web member and the first and second end portion of the second web member. The wall panel system further includes an internal fastener configured to connect at least one of first end portion or the second end portion to a portion of the second wall panel and the second wall panel to a building support structure.

8 Claims, 5 Drawing Sheets

(56) References Cited

U.S. PATENT DOCUMENTS

| | | | | | |
|---|---|---|---|---|---|
| 4,177,615 | A * | 12/1979 | Anderson | E04D 3/352 | 52/394 |
| 4,184,301 | A * | 1/1980 | Anderson | E04B 1/6104 | 52/592.4 |
| 4,366,660 | A * | 1/1983 | Pearson | E04F 13/0801 | 52/712 |
| 4,575,981 | A * | 3/1986 | Porter | E04D 3/355 | 52/309.9 |
| 4,700,520 | A * | 10/1987 | Ting | E04D 3/365 | 52/520 |
| 6,253,511 | B1 * | 7/2001 | Boyer | E04C 2/292 | 52/235 |
| 7,419,335 | B1 * | 9/2008 | Cohen | E04G 23/0229 | 52/223.13 |
| 7,748,181 | B1 * | 7/2010 | Guinn | E04C 2/292 | 52/592.1 |
| 2007/0011969 | A1 * | 1/2007 | Little | E04F 13/042 | 52/415 |
| 2010/0170173 | A1 * | 7/2010 | Boyer | E04C 2/296 | 52/235 |
| 2014/0102029 | A1 * | 4/2014 | Manser | E04B 2/88 | 52/506.05 |
| 2014/0360128 | A1 * | 12/2014 | Foral | E04B 2/828 | 52/745.1 |
| 2017/0130464 | A1 * | 5/2017 | Gleeson | E04F 13/0846 | |
| 2019/0309527 | A1 * | 10/2019 | Bergelin | E04F 15/02044 | |
| 2022/0112724 | A1 * | 4/2022 | Chang | E04F 13/0821 | |

* cited by examiner

WALL PANEL CLIP

CROSS-REFERENCE TO RELATED PATENT APPLICATIONS

This application is a non-provisional patent application which, pursuant to 35 U.S.C. 119(e), claims priority to and the benefit of U.S. Provisional Application No. 63/253,951, filed Oct. 8, 2021, which is incorporated by reference herein in its entirety.

TECHNICAL FIELD

The disclosure relates generally to an apparatus, system and method for assembling prefabricated wall panels to a support structure.

BACKGROUND

Many buildings that utilize a metal wall structure enclose the building with prefabricated insulated wall panels. Currently, affixing insulated wall panels to one another and to the underlying building structure requires a user to have a high degree of skill to know when a fastener can be further tightened without causing damage to the wall panel. Excess tightening or loading of fasteners coupled directly to the wall panels can compromise the outer metal layer and can potentially damage the internal insulation of the wall panel.

SUMMARY OF THE INVENTION

According to a first aspect, there is provided a wall panel clip for connecting adjacent insulated wall panels together. The wall panel clip includes a first web member having a first or top end portion, a second or bottom end portion and a middle or intermediate portion, the intermediate portion disposed between the top end portion and the bottom end portion. The wall panel clip also includes a second web member angularly extending from the first web member, the second web member having a first or top end portion, a second or bottom end portion and a middle or intermediate portion disposed between the top end portion and the middle end portion. The first web member includes a through-hole located at and extending through the middle portion and each of the respective end portions of the second web member have a through-hole located at and extending therethrough.

According to one embodiment, a plurality of through-holes are disposed in the first web member.

According yet another embodiment, the wall panel clip further includes a plurality of through-holes in at least one of the top end portion and the bottom end portion in the second web member.

In still another embodiment, the second web member extends from the first web member at an angle not more than about 90 degrees.

In other embodiments, the angle is about 88 degrees.

According to yet another embodiment, the first web member and the second web member are each substantially planar.

According to some embodiments, the first web member is folded relative to the second web member along an edge.

According to a second aspect, there is provided an insulated wall panel system that includes a first wall panel. The wall panel system includes a wall panel clip configured to be secured to the first wall panel and the second wall panel that includes a first web member and a second web member extending at an angle from the first web member. The first web member includes a first end portion, a second end portion and a middle portion disposed between the first and second end portions. The second web member includes a first end portion, a second end portion and a middle portion disposed between the first and second end portions. The wall panel system further includes that the first web member middle portion includes a through hole extending therethrough and the first and second end portions of the second web member each include a through-hole extending therethrough. The wall panel system includes an internal fastener configured to be positioned within the through hole on at least one of the first end portion, the second end portion or the middle portion to secure the internal fastener to the first wall panel and a building support structure.

According to some embodiments, the system further includes a second wall panel positioned such that the wall panel clip is disposed between the first and second wall panels. A face fastener extends through the second wall panel, the wall panel clip and at least partially through the first wall panel to secure the first wall panel to the second wall panel.

According to other embodiments, the angle between the first and second web members is at most about 90 degrees.

In yet another embodiment, the angle between the first and second web members is about 88 degrees.

In another embodiment, the first web member and the second web member are each substantially planar.

In still other embodiments, the face fastener has a length that is less a thickness of the first wall panel.

According to some embodiments, the first and second wall panels are insulated wall panels.

According to a third aspect, there is provided a method of manufacturing a wall panel clip, the wall panel clip configured to secure adjacently positioned wall panels to a building support structure. The method includes the steps of providing a first web member having a top or first end portion, a second or bottom end portion and an intermediate or middle portion disposed between the top end portion and the bottom end portion. The method further includes the step of providing a second web member angularly extending from the first web member, the second web member having a first or top end portion, a second or bottom end portion and an intermediate or middle portion. The method also includes the step of forming a through-hole through the middle portion of the first web member and forming a through-hole though each of the respective end portions of the second web member.

According to some embodiments, the method further includes the step of welding the first web member to the second web member.

In still other embodiments, providing the second web member angularly extending from the first web member includes positioning the second web member at an angle with respect to the first web member not more than 90 degrees.

According to another embodiment, providing the second web member angularly extending from the first web member includes positioning the second web member at an angle with respect to the first web member of about 88 degrees.

In still other embodiments, the method further includes forming a plurality of through-holes through the middle portion of the first web member.

In still yet another embodiment, the method further includes forming a plurality of through-holes on each of the first end portion and the second end portion of the second web member.

According to a fourth aspect, there is provided a method of securing a wall panel to a building support member. The method includes aligning a wall panel clip with a predetermined location on the wall panel. The wall panel clip includes a first web member and a second web member extending at an angle from the first web member. The first web member further includes a first end portion, a second end portion and a middle portion disposed between the first and second end portions. The second web member includes a first end portion, a second end portion and a middle portion disposed between the first and second end portions. The first web member middle portion includes a through-hole extending therethrough and the first and second end portions of the second web member each include a through-hole extending therethrough. The method further includes inserting a temporary fastener through a through-hole on either the first web member or the second web member to temporarily secure the wall panel clip to the wall panel. The method also includes inserting an internal fastener through a through-hole on the other of the first web member or the second web member to secure the internal fastener to the first wall panel and a building support structure. The method further includes removing the temporary fastener from the through-hole.

BRIEF DESCRIPTION OF THE DRAWINGS

The disclosure will become more fully understood from the following detailed description, taken in conjunction with the accompanying figures, wherein like reference numerals refer to like elements, in which.

Figure 1:
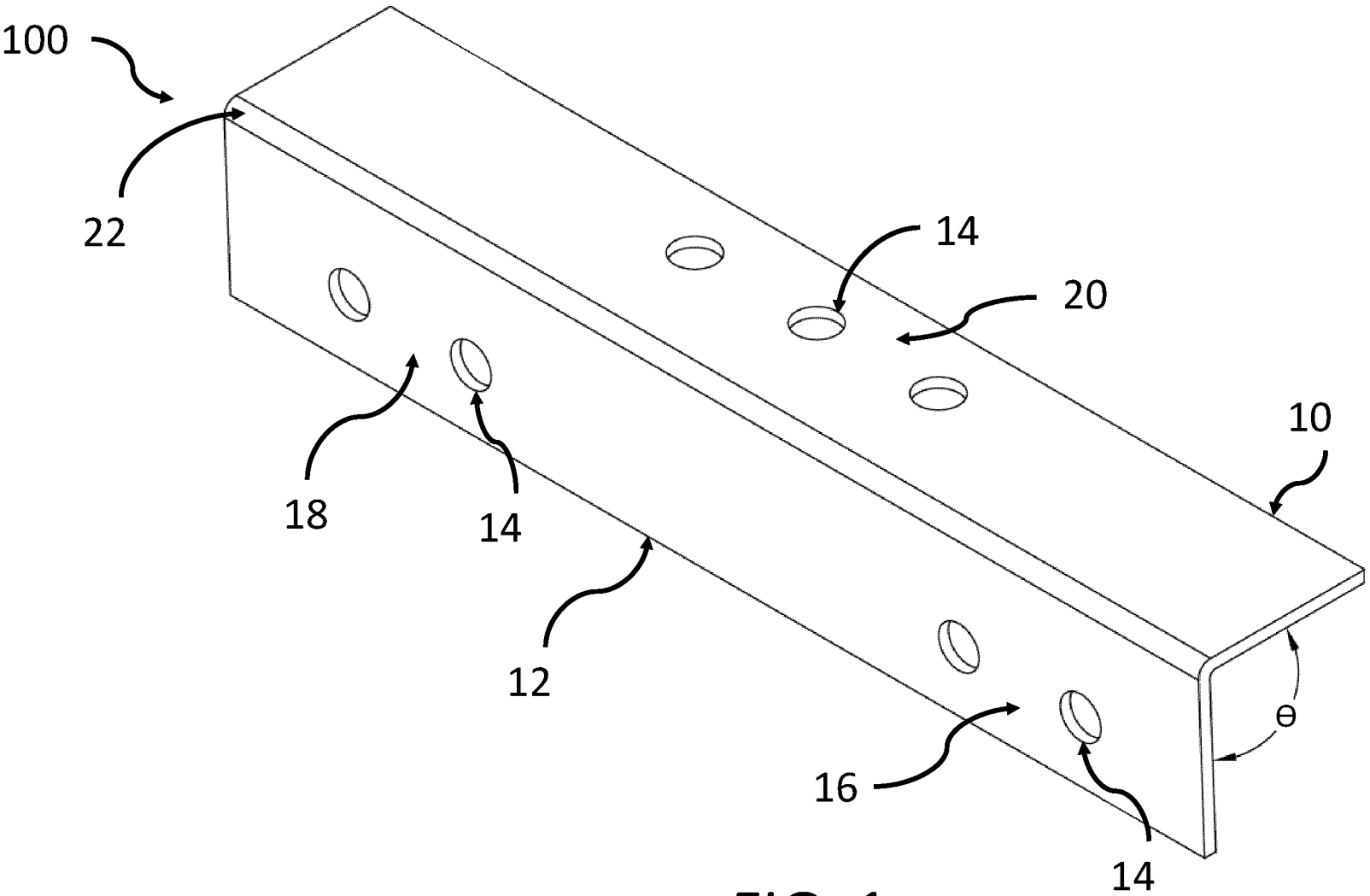
FIG. 1 is a top side perspective view of an embodiment of a wall panel clip of the present disclosure.

The drawings are not necessarily to scale and certain features may be shown exaggerated in scale or in somewhat schematic form in the interest of clarity and conciseness.

DETAILED DESCRIPTION

Embodiments disclosed herein provide a system, apparatus, and method for a wall panel system 200 in which a wall panel clip 100 is employed to advantage. In particular and referring to FIGS. 1-4, the wall panel clip system 200 that utilizes a wall panel clip 100 to affix a first wall panel 26 to a second wall panel 34 while simultaneously connecting both wall panels 26 and 34 to a supporting structure such as a wall support 28, 30.

In the embodiment illustrated in FIG. 1, the wall panel clip 100 includes a first web member 10, a second web member 12, and a plurality of through holes 14. The second web member 14 connects to the first web member 12 at an edge or intersection 22 and angularly extends from the first web member 10 at an angle θ.

As illustrated in FIG. 1, the wall panel clip 100, and in particular, the web members 10 and 12, each include a first or bottom end portion 16, a top end or second portion 18, and a mid or intermediate portion 20 disposed between the end portions 16 and 18. Referring specifically to FIG. 1, the end portions 16 and 18 are disposed generally at the ends of the wall panel clip and are sized to receive at least one through-hole 14. The middle or intermediate portion 20 is also sufficiently sized to receive at least one through-hold 14. In the embodiment illustrated in FIG. 1, three through-holes 14 are disposed on the first web member 10 and two through holes 14 are disposed on the second web member 12 on each end portion 16 and 18. However, it should be understood that other configurations for the wall panel clip 100 may be utilized. For example, in some embodiments, one or more through-holes 14 may be formed only on one end portion 16 or 18. In other embodiments, one or more through-holes 14 may be disposed on both of the end portions 16 and 18 and the middle portion 20 may have no through-holes 14 thereon. In still other embodiments, the configuration of the through-holes 14 may be rearranged such that the first web member 10 contains through-holes 14 in the end portions 16 and 18 and the send web member 12 contains through-holes 14 in the middle portion 20.

It should be understood, however, in addition to the position of through-holes 14 being otherwise configured, there may be a greater or fewer number of through holes 14 disposed on each portion 16, 18 and/or 20. For example, in one embodiment, each one of the middle portion 20, the top and bottom end portions 16 and 18 each include one through hole 14.

According to some embodiments, the wall panel clip 100 can be formed of a single unitary piece of material, such as a metallic material, that is bent along the intersection point 22. In other embodiments, the wall panel clip 100 can be formed of multiple pieces/sections such that the first web member 10 and the second web member 12 are separate components and coupled together generally along the intersection point 22. For example, the web members 10 and 12 can be joined at the intersection point 22 by welding or any other suitable fastening method or mechanism.

With continued reference to FIG. 1, according to some embodiments, the angle θ between the first web member 10 and the second web member 12 is less than 90 degrees, such as, for example, 88 degrees. In other embodiments, the angle θ is less than or equal to 90 degrees. In other embodiments, the angle θ can be up to 120 degrees depending on the particular application.

Figure 2:
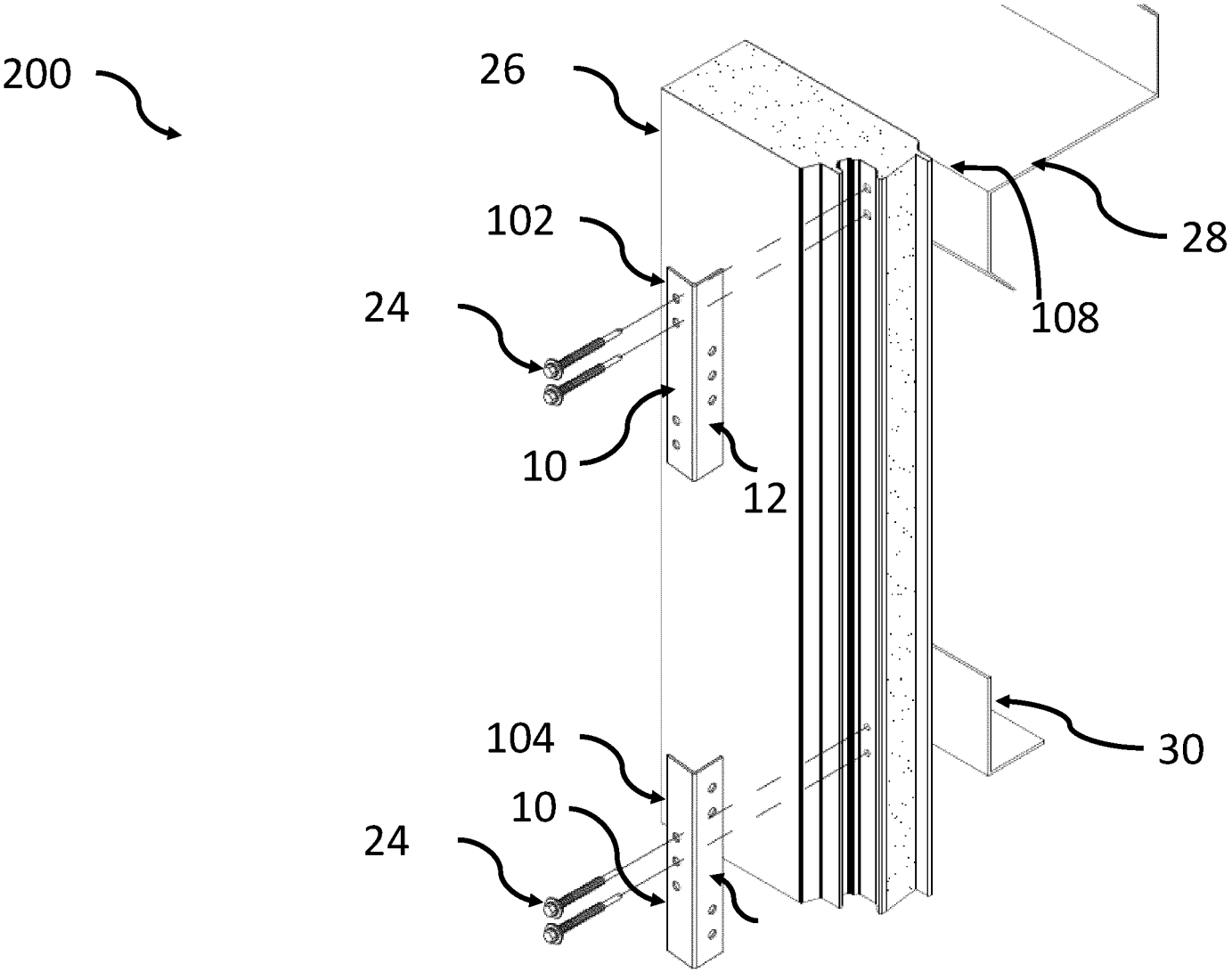
FIG. 2 is a top side exploded perspective view of an embodiment of a wall panel clip system of the present disclosure.
Figure 3:
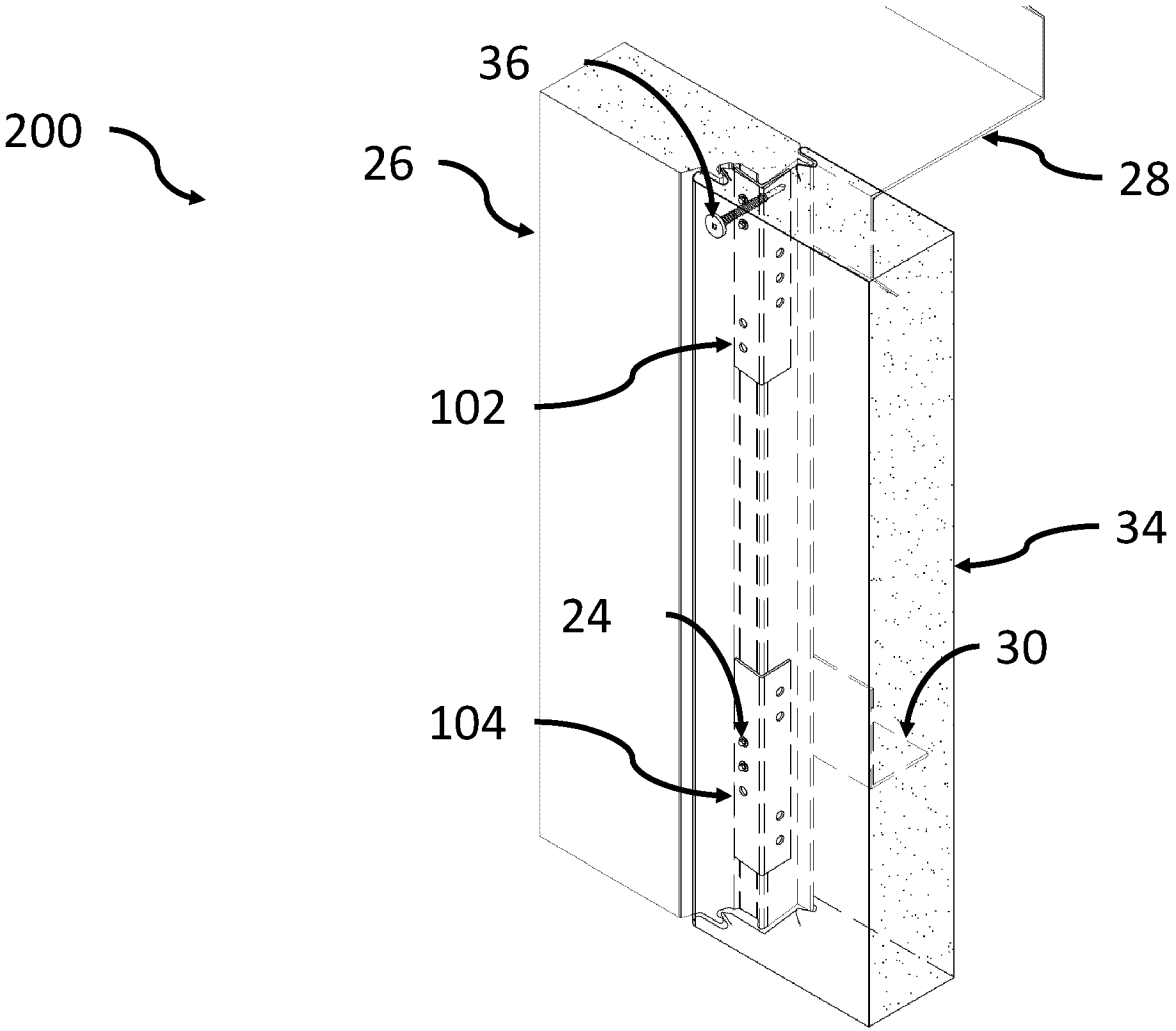
FIG. 3 is a top side perspective view of an embodiment of a wall panel clip system of the present disclosure.
Figure 4:
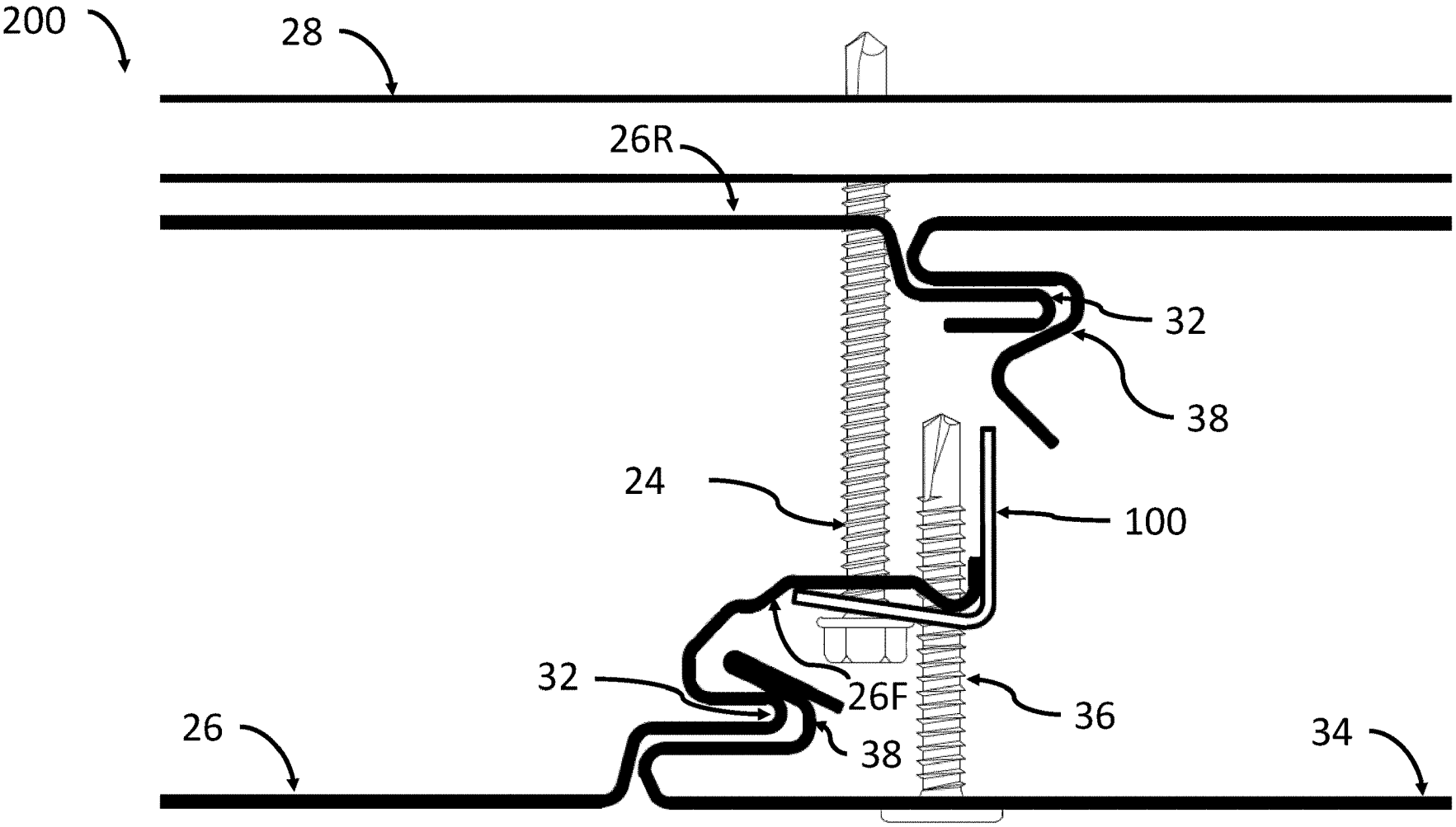
FIG. 4 is a top plan cutaway view of an embodiment of a wall panel clip system of the present disclosure.

Reference is now made specifically to FIGS. 2-4 in which wall panel clip 100 is illustrated being utilized as an end clip 102 and a second wall panel clip 100 is being utilized and otherwise positioned as an intermediate or middle clip 104. As discussed more fully below, both clips 102 and 104 are used with a plurality internal and face fasteners 24 and 36, respectively, to secure first and second wall panels 26 and 34 to wall supports, such as an end wall support 28 and an intermediate wall support 30. As illustrated, a wall panel clip 100 can be utilized as either an end clip 102 or an intermediate clip 104. To transition from one configuration to the other, the user need to only change how the web member 12 or 14 is positioned and engaged with the first wall panel 26 so as to receive the internal fastener 24. For example and referring to FIGS. 2-4, when using as an intermediate clip 104, the first web member 10 is positioned to receive the internal fastener 24 such that the internal fastener 24 passes through both the front and rear rigid faces 26F and 26R of the first wall panel 26 and into an intermediate wall support 30. While the wall panel clip 100 is in the intermediate clip 104 configuration, the wall panel clip 104 does not extend vertically above or below the first wall panel 26 and, as explained below, is covered by the second wall panel 34, as explained in greater detail below.

Referring to the end clip 102, the second web member 12 is positioned to receive the internal fastener 24 such that the internal fastener 24 passes through both the front and rear rigid faces 26F and 26R of the first wall panel 26 and into an end wall support 28. While the wall panel clip 100 is in the end clip configuration 102, either the bottom end portion 16 or the top end portion 18 is positioned at either the top or bottom end of the first wall panel 26, respectively. In such a configuration, the wall panel clip 100 do not extend vertically above or below the first wall panel 26 and is substantially covered or concealed by the second wall panel 34, as explained in greater detail below.

Figure 5:
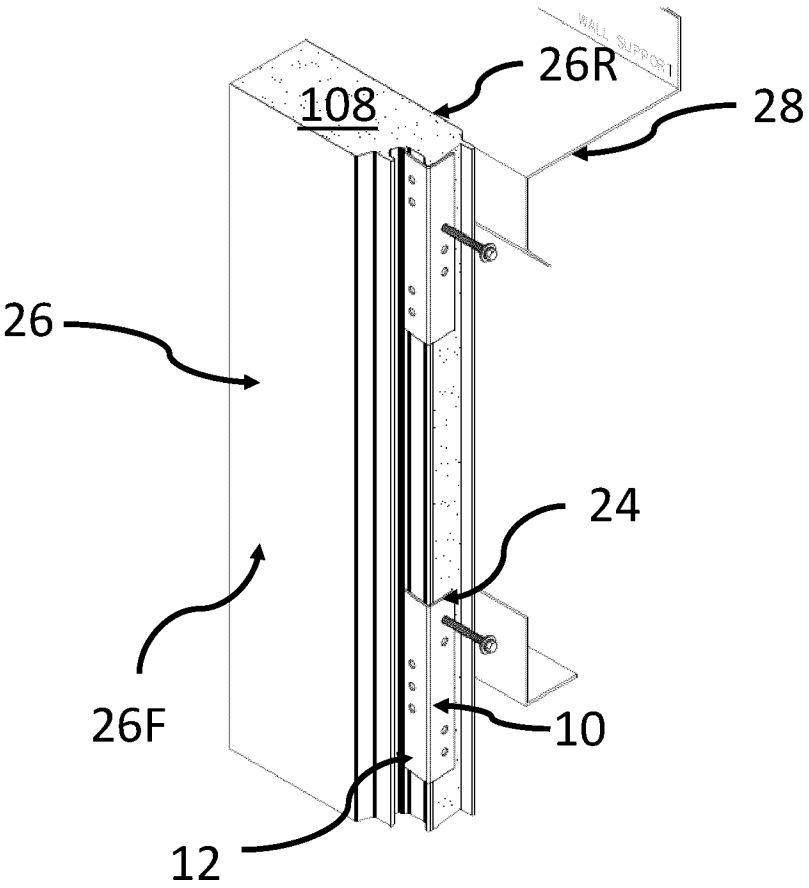
FIG. 5 is a view of an end of the wall panel clip of FIG. 1 illustrating temporary fastener supporting the wall panel clip against a wall panel.

Referring now to FIG. 5, when the wall panel clip 100 is utilized as either an end clip 102 or intermediate clip 104, an installer can utilize the through-holes 14 not configured to receive the internal fastener 24 to aid in aligning and connecting the wall panel clip 100. As such, once the installer determines the suitable position for the wall panel clip 100, prior to the installation of the internal fastener 24, an installer can inserts a temporary fastener 24 laterally into the first wall panel 26. As illustrated in FIG. 5, the first wall panel 26 includes insulation 108 therein. Since the insulation 108 is generally easily deformable by an installer, the installer can provisionally align multiple wall panel clips 100 on the wall panel 26 before installing the internal fasteners 24. The ability to easily provisionally align multiple wall panel clips 100 aids to reduce the amount of work that must be re done by increasing the likelihood that all necessary wall panel clips 100 for a particular wall panel can be installed in their desired locations without undue interference with other components. The ability to perform this provisional alignment prior to the more permanent installation of the internal fasteners 24 increases the probability that the final installation will be correct.

As discussed more fully below and referring specifically to FIGS. 2-4, a method of assembling the wall panel clip system 200 is disclosed. According to some embodiments, a first wall panel 26 is positioned adjacent to a structural support of a building, such as a wall support 28 and/or 30. A wall panel clip 102 is positioned on and/or otherwise adjacent to an end portion 108 of the first wall panel 26 such that at least one of the through holes 14 aligns with the upper wall support 28, as seen for example, in FIG. 2. A fastener 24 is inserted into the desired through-hole 14, the first wall panel 26, and the wall support 28. As illustrated in FIGS. 3 and 4, a second wall panel 34 is positioned and aligned such that a portion of the second wall panel 34 substantially covers the wall panel clip 102 and a face fastener 36 is inserted through the portion of the second wall panel 34 that covers the wall panel clip 100. The face fastener 36 is sized having a length such that it extends through the second wall panel 34 and the wall panel clip 100 and at least partially into the first wall panel 26. When installed, the wall panel clip 102 functions provides a structural support for the second wall panel 34. The same process described above with respect to the wall panel clip 102 can be repeated for each intermediate panel clip 104 and fastener 24 is used to secure the first wall panel 26 to building support 30 (as opposed to building support 28), as illustrated for example, in FIG. 3.

The first wall panel 26 and the second wall panel 34 can be prefabricated wall panels, such as prefabricated wall panels constructed with a layer of insulation coupled to a pre-formed metal layer. Both wall panels 26 and 34 have a male end that is configured to couple with a corresponding female end. As shown in FIG. 4, the male end of the first wall panel 26 includes two extending portions 32 that fit into recessed portions 38 of the second wall panel's 34 female end. The recessed portions 38 and the corresponding extending portions 32 aid in aligning the first wall panel 26 with respect to the second wall panel 34 to ensure a proper fit between the first wall panel 26 and the second wall panel 34. However, those of skill in the art will readily recognize that the wall panel clip system 200 can utilize any suitable form of aligning the first wall panel 26 with the second wall panel 34.

The internal fastener 24 has a length such that it extends through a through hole 14, or other portion of the wall panel clip 100, through the first wall panel 26, and engages with a wall support 28, 30. According to some embodiments, the internal fastener 24 is the only fastener of the wall panel clip system 200 that functions to affix the first wall panel 26 to a wall support 28, 30. In other embodiments, multiple internal fasteners 24 are utilized with the wall panel clip system 200.

The internal fastener 24, as illustrated in the depicted embodiments, is a male threaded fastener with a hex shaped head on one end and an opposed self-tapping end. The self-tapping end allows for a user to save time when assembling a wall panel clip system 200 by not having to pre-drill aligned holes in the first wall panel 26 and the wall support 28, 30. However, the internal fastener 24 can be any fastener suitable for affixing a wall panel clip 100 to a first wall panel 26 and a wall support 28, 30.

The face fastener 36, as illustrated in the depicted embodiments, is a male threaded fastener with a low profile head on one end and an opposed self-tapping end. The self-tapping end allows for a user to save time when assembling a wall panel clip system 200 by not having to pre-drill aligned holes in the first wall panel 26 and the second wall panel 34. The low profile head has enhances the overall aesthetic of the exterior of the building. However, the face fastener 36 can be any fastener suitable for affixing a wall panel clip 100 to a first wall panel 26, a second wall panel 34 and a wall support 28, 30 with any suitable head, low profile or otherwise.

Manufacturing a wall panel clip 100 includes the steps of first obtaining a substantially planar metal piece of material with a length and a width. Then, bending the substantially metal piece of material along an axis or intersection point 22 that is positioned at the approximate midpoint of the width to an angle θ. Then, forming a plurality of openings or through holes 14 positioned on either side of the bend or intersection point 22.

Alternatively, a wall panel clip 100 can be manufactured by providing two separate and distinct members, specifically a first web member 10 and a second web member 12. Then, joining the first web member 10 and the second web member 12 at the intersection point 22 of each respective web members 10, 12 at an angle θ by welding, construction adhesive, fasteners, or any other suitable means for joining the first web member 10 to the second web member 12.

According to some embodiments, a method of installing a wall panel clip system 200 includes the steps of providing a wall panel clip 100 having a first web member 10 connected to a portion of a second web member 12 at an angle θ, the first and second web member 10 and 12 each having at least one through hole 14. The method also includes the steps of providing an internal fastener 24 configured to be received through at least one through hole 14 of the wall panel clip 100 and providing a face fastener 36, configured to be received through at least one through hole 14 of the wall panel clip 100.

It should be understood that the clip system 200 may be utilized with or without a face fastener 36. Put another way, it should be understood that in some embodiments, the wall panel clip 100 may be used to secure a wall panel 26, 34 to a support structure 28, 30 without the need for a face fastener 36.

Although embodiments of a wall panel clip 100 and wall panel clip system 200 have been described in detail, those skilled in the art will also recognize that various substitutions and modifications may be made without departing from the scope and spirit of the appended claims.

In the foregoing description of certain embodiments, specific terminology has been resorted to for the sake of clarity. However, the disclosure is not intended to be limited to the specific terms so selected, and it is to be understood that each specific term includes other technical equivalents which operate in a similar manner to accomplish a similar technical purpose. Terms such as "left" and right", "front" and "rear", "above" and "below" and the like are used as words of convenience to provide reference points and are not to be construed as limiting terms.

In this specification, the word "comprising" is to be understood in its "open" sense, that is, in the sense of "including", and thus not limited to its "closed" sense, that is the sense of "consisting only of". A corresponding meaning is to be attributed to the corresponding words "comprise", "comprised" and "comprises" where they appear.

In addition, the foregoing describes some embodiments of the disclosure, and alterations, modifications, additions and/or changes can be made thereto without departing from the scope and spirit of the disclosed embodiments, the embodiments being illustrative and not restrictive.

Furthermore, the disclosure is not to be limited to the illustrated implementations, but to the contrary, is intended to cover various modifications and equivalent arrangements included within the spirit and scope of the disclosure. Also, the various embodiments described above may be implemented in conjunction with other embodiments, e.g., aspects of one embodiment may be combined with aspects of another embodiment to realize yet other embodiments. Further, each independent feature or component of any given assembly may constitute an additional embodiment.

What is claimed is:

1. A wall panel system, comprising:

a first wall panel including a front face, a second face and insulation between the front face and the second face, wherein the first wall panel comprises a male end and a female end; and a plurality of wall panel clips configured to be secured to the first wall panel, the plurality of wall panel clips including a first web member and a second web member extending at an angle from the first web member at an intersection, the first web member further including a first end portion, a second end portion and a middle portion disposed between the first end portion and the second end portion of the first web member, the second web member having a first end portion, a second end portion and a middle portion disposed between the first end portion and the second end portion of the second web member;

wherein the middle portion of the first web member includes one or more middle through-holes extending therethrough, and the first end portion and the second end portion of the second web member each include one or more end through-holes extending therethrough;

wherein a first wall panel clip of the plurality of wall panel clips is oriented in a first orientation as an end wall panel clip such that the one or more end through-holes of the first end portion or the second end portion of the second web member receives one or more internal end fasteners that extend through the first wall panel and one or more support structures; and wherein a second wall panel clip of the plurality of wall panel clips is oriented in a second orientation as an intermediate clip such that the one or more middle through-holes receive one or more internal middle fasteners that extend through the first wall panel the one or more support structures.

2. The wall panel system of claim 1, further comprising:

a second wall panel, the second wall panel positioned such that the plurality of wall panel clips are disposed between the first and second wall panels; and a face fastener extending through the second wall panel, the first wall panel clip or the second wall panel clip, and at least partially through the first wall panel to secure the first wall panel to the second wall panel.

3. The wall panel system of claim 1, wherein the angle between the first and second web members is at most about 90 degrees.

4. The wall panel system of claim 1, wherein the angle between the first and second web members is about 88 degrees.

5. The wall panel system of claim 1, wherein the first web member and the second web member are each substantially planar.

6. The wall panel system of claim 2, wherein the face fastener has a length that is less a thickness of the first wall panel.

7. The wall panel system of claim 1, wherein the plurality of wall panel clips are located between the front face and rear face of the first wall panel, wherein the intersection of each of the plurality of wall panel clips extend around a portion of the male end of the first wall panel formed from an edge of the front face, and wherein the first web member for the first wall panel clip or the second web member for the second wall panel clip is located between the male end of the first wall panel and the female end of an adjacent second wall panel.

8. A method of securing a wall panel to one or more support structures, wherein the wall panel includes a front face, a second face and insulation between the front face and the second face, and wherein the wall panel comprises a male end and a female end, the method comprising:

assembling a plurality of wall panel clips to the wall panel, wherein the plurality of wall panel clips comprise a first web member and a second web member extending at an angle from the first web member at an intersection, the first web member further including a first end portion, a second end portion and a middle portion disposed between the first end portion and second end portion of the first web member, the second web member having a first end portion, a second end portion and a middle portion disposed between the first end portion and second end portion of the second web member, the middle portion of the first web member includes one or more middle through-holes extending therethrough, and the first end portion and second end portion of the second web member each include one or more end through-holes extending therethrough, wherein assembling the plurality of wall panel clips comprise;

assembling a first wall panel clip of the plurality of wall panel clips as an end wall panel clip oriented in a first orientation by inserting one or more internal end fasteners through the one or more end through-holes on the second web member to secure the one or more internal end fasteners to the wall panel, the first wall panel clip, and one or more support structures; and assembling a second wall panel clip of the plurality of wall panel clips as an intermediate wall panel clip oriented in a second orientation by inserting one or more internal middle fasteners through the one or more middle through-holes on the first web member to secure the one or more internal middle fasteners to the wall panel, the second wall panel clip, and the one or more support structures.

* * * * *